US007043791B2

(12) United States Patent
Saito

(10) Patent No.: US 7,043,791 B2
(45) Date of Patent: May 16, 2006

(54) APPLICATOR

(75) Inventor: Yuko Saito, Tokyo (JP)

(73) Assignee: Aubex Corporation, Tokyo (JP)

( * ) Notice: Subject to any disclaimer, the term of this patent is extended or adjusted under 35 U.S.C. 154(b) by 502 days.

(21) Appl. No.: 10/269,066

(22) Filed: Oct. 11, 2002

(65) Prior Publication Data

US 2003/0075201 A1 Apr. 24, 2003

(30) Foreign Application Priority Data

Oct. 16, 2001 (JP) ..... 2001-317705

(51) Int. Cl.
*A45D 40/26* (2006.01)

(52) U.S. Cl. ..... 15/159.1; 15/160; 15/207.2; 264/258; 132/320

(58) Field of Classification Search ..... 15/159.1, 15/160, 207.2, 106–107, 191.1, 192; 300/21; 156/72, 296, 309.6; 264/259, 261, 258; 132/200, 132/320

See application file for complete search history.

(56) References Cited

U.S. PATENT DOCUMENTS 3,442,739 A * 5/1969 Johnson ..... 156/180
3,864,183 A * 2/1975 Hori ..... 156/180

* cited by examiner

*Primary Examiner*—Richard Crispino
*Assistant Examiner*—Shay L. Balsis
(74) *Attorney, Agent, or Firm*—McDermott Will & Emery LLP

(57) ABSTRACT

An applicator suitable for applying various powders and liquids in the fields of cosmetics, writing, painting, and medical treatment etc, which is particularly preferred as a make-up instrument such as a chip or a brush for applying eye shadow, and to a method of producing the applicator. The applicator has one or two coating parts obtained by grinding the peripheral part of either or both ends of an applicator main body which is made by bonding a fiber bundle with a synthetic resin solution, and a holding part being the unground middle part of the applicator main body, wherein the applicator main body impregnated with the resin solution is dried by hot air and the solvent in the resin solution is removed, thereby the resin is unevenly distributed and exists more in the peripheral part, and the peripheral part becomes harder than the central part.

5 Claims, 5 Drawing Sheets

APPLICATOR

BACKGROUND OF THE INVENTION

1. Field of the Invention

The present invention relates to an applicator for coating of various powders and liquids, which is used in the fields of cosmetics, writing, painting, and medical treatment or the like, and to a method of producing the applicator.

In particular, it relates to an applicator which is used as a makeup instrument, a writing instrument, a painting instrument and a medical device, more particularly it relates to a chip or a brush preferably used for applying eye shadow and to a method of producing the same.

2. Description of the Related Art

Various applicators including writing instruments have been employed widely in fields ranging from painting to medical treatment.

Therefore, the shapes thereof vary greatly with their uses.

For example, applicators for makeup are commercially available in the form of a brush and a sponge or the like as products including a face brush, a cheek brush, an eye shadow brush, an eye shadow chip (applicator), an eye color brush, an eye color chip (applicator) and a lip brush.

There are also various methods for producing applicators such as a method in which animal hairs or synthetic fibers are bundled into a writing or painting brush; a method in which the tip of a bundle of fibers bonded with an adhesive is processed into a coating member having a sharp form; a method of producing a molded product, having a tip as a coating member which is made of a porous sponge material of a synthetic resin; and a method of producing, as a coating member, an extrusion molded product of an elastic or soft thermoplastic synthetic resin wherein slit-like capillaries are formed.

The above-mentioned various applicators have constantly been examined for improvement. Among them, an applicator for eye shadow powder such as an eye shadow chip (applicator) and an eye shadow brush is known to have the following problems, therefore, the elimination thereof has been eagerly desired.

That is, a sponge chip (applicator) and an NBR chip (applicator) change largely with time, and discolor and harden in many occasions, therefore they tend to be deteriorated and crumbled.

A flocky chip (applicator) produced by static flocking method has a problem of loosing flocks.

Animal hairs have problems from the viewpoint of environmental protection and animal protection, and they have a problem of high cost as well.

In consideration of the above-mentioned present situation, the inventors have tried to solve the problems by the use of a bundle of fibers, in particular, synthetic fibers, which are widely employed for a writing instrument such as a pen and a brush.

As a result, the inventors have found that an excellent applicator for makeup can be obtained by uneven distribution of a synthetic resin which is used for binding and bonding a bundle of fibers, such that the amount of the synthetic resin is more in the peripheral part of the fiber bundle and less in the central part thereof, thereby making the peripheral part of the bundle harder and the central part of the bundle softer, and completed this invention.

SUMMARY OF THE INVENTION

Accordingly, it is an object of the present invention to provide an applicator, which has good durability, which can be employed for a wide range of uses, which can be produced easily at a reasonable cost, and a method of producing the same.

According to a first aspect of the present invention, an applicator has a main body which is made by bonding a fiber bundle with a synthetic resin, and is characterized by one or more coating parts obtained by grinding the peripheral part of either or both ends of the main body and a holding part being the unground middle part of the main body, wherein the bonding is carried out in such a way that the hardness of the peripheral part becomes higher than that of the central part of the main body.

Preferably, the difference in the hardness between the peripheral part and the central part arises from uneven distribution of the synthetic resin employed for bonding the fiber bundle, the resin being present in a larger amount in the peripheral part than in the central part.

Preferably, the Durometer Hardness measured by JISK 6301 A type of the peripheral part is more than 1.3 times higher than the Hardness of the central part.

Preferably, the Durometer Hardness measured by JISK 6301 A type of the peripheral part is not less than 30, and at least 1.3 times higher than the Hardness of the central part.

Preferably, the synthetic resin employed for the bonding is polyurethane resin and the fiber bundle is polyester fiber bundle or nylon fiber bundle.

Preferably, the fiber bundle is loosened in the coating part.

Preferably, the coating part has an angular, cylindrical, semispherical, or bullet-like form.

According to a second aspect of the present invention, a method of producing an applicator, includes immersing a fiber bundle of a desired thickness in a resin solution for bonding, curing the fiber bundle impregnated with the resin solution in such a way that the hardness of the peripheral part becomes higher than that of the central part, to form a main body; and grinding the peripheral part of either or both ends of the obtained main body to form one or two coating parts.

The method may include immersing a fiber bundle of a desired thickness in a resin solution, and curing the fiber bundle in such a way that the peripheral part becomes harder than the central part, wherein the resin is unevenly distributed and present in a larger amount in the peripheral part than in the central part by removing the solvent in the impregnating resin solution from the surface of the fiber bundle at one end while the other end of the fiber bundle is still immersed in the resin solution.

Preferably, the fiber bundle impregnated with the resin solution is dried by hot air, thereby the solvent in the resin solution is removed from the surface of the fiber bundle and the peripheral part is made harder than the central part.

As an applicator according to the present invention is produced by bonding a fiber bundle with a resin to form the main body of the applicator, while setting the hardness of the peripheral part of the fiber bundle higher than that of the central part, it shows excellent weather resistance, and it is free from a problem such as loosing flocks, or the problems owned by applicators for make-up, in particular, applicators for eye shadow powder, eye shadow chip (applicators), and eye shadow brushes, such as the big changes with time, discoloration, or deterioration due to the hardening of the resin and the like.

According to the method of producing the applicator of the present invention, an applicator of high quality having excellent weather resistance which is free from a problem of loosing flocks can be produced in a very simple method in which a fiber bundle is bonded with a resin and the solvent contained in the resin is removed from the periphery by an appropriate means.

The method is further advantageous since the conventionally employed equipment can be converted, actually simplified, for use in this method, and the production cost is lowered.

DESCRIPTION OF THE PREFERRED EMBODIMENTS

Figure 1:
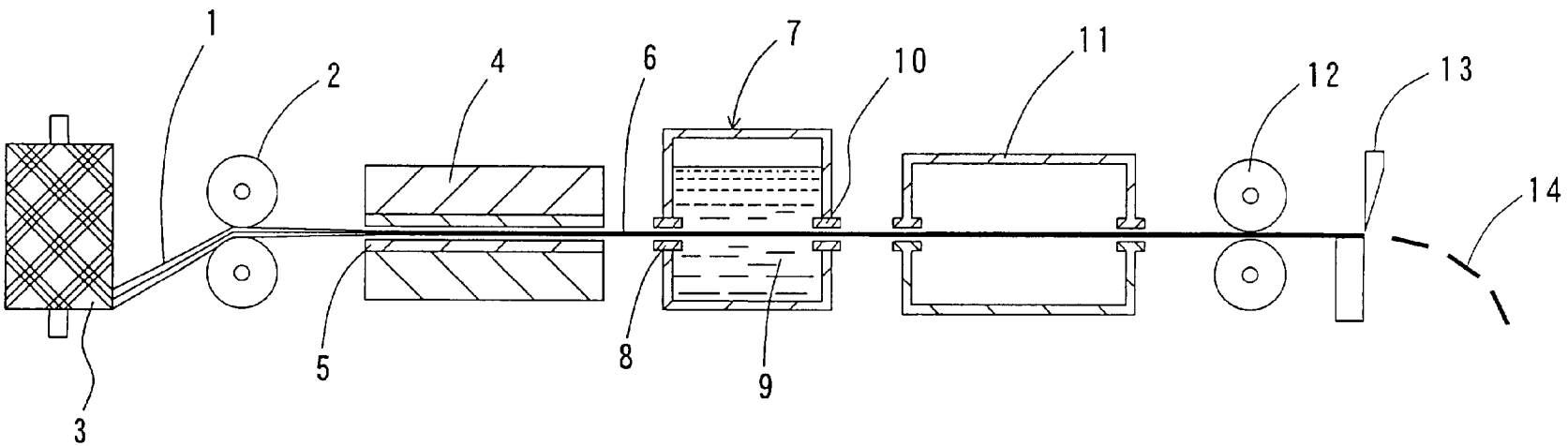
FIG. 1 is a process drawing showing one example of the production process of an applicator according to the present invention.

An applicator according to the present invention has a main body comprising a fiber bundle bonded with a synthetic resin (hereinafter simply referred to as "resin"), in the manner similar to a nib of a conventional pen, but the hardness of the peripheral part of the fiber bundle impregnated with the resin is made higher than that of the central part. Examples of the fibers and resins include the following.

Fibers which are used to form the applicator include synthetic fibers such as nylon, polyester, acryl, and vinylon. Among these synthetic fibers, preferred are polyester fibers, which allow easy production of an applicator in the form of a brush, and nylon fibers, which provide soft feel on use.

Though a size of the fibers depends on usage of the applications, generally fibers having single yarn dtex of 1–100 are employed. Typically, fiber having 2–50 dtex are preferred. The total dtex of the fiber to be used shall be decided according to the use, the form and the outer diameter or the like of the applicator, but normally it is 3,000–170,000 dtex.

The resins used for bonding the fiber bundle include thermosetting resins such as unsaturated polyester, urea formalin resin, phenol, epoxy, melamine, polyurethane, and thermoplastic resins such as polyvinyl acetate, polyolefin, and low melting point polyester. Among them, polyurethane resin is preferred from the viewpoint of coating properties, resin characteristics, adaptability to applicators and productivity and the like.

Polyurethane resin comprises a polyisocynate and a polyol.

Examples of the polyisocyanate include;

diisocyanate compounds represented by tolylene diisocyanate, diphenyl methane diisocyanate, polymethylene polyphenyl isocyanate, hexamethylene diisocyanate, xylylene diisocyanate or the like;

diisocyanate compounds derived from a diol or a diamine and a diisocyanate;

triisocyanate compounds and derivatives thereof produced from 1 molecule of trimethylol propane and 3 molecules of toluylene diisocyanate; and block isocyanate compounds obtained by masking the isocyanate group with a blocking agent such as phenol and cresol.

These resins are employed in the form of a solution for bonding the fiber bundle.

As for the solvent, those which can be easily recovered and reused and which evaporate quickly are preferred for making such a solution.

Specifically, methylene chloride, methanol, acetone, and ethyl acetate or the like can be used as the base and phenol, cresol, dimethyl formamide, and dimethyl acetoamide or the like are used in combination.

Though the concentration shall depend on the impregnation conditions and the like, a resin solution having a resin concentration of 1–30 weight % is preferred. Those having a concentration of 2–30 weight % are more preferred, and in particular, those having a concentration of 2–20 weight %, and having a viscosity of up to 50 cps are most preferred.

The fiber bundle of the applicator according to the present invention is bonded by these resins. It is essentially required that the hardness of the peripheral part of the applicator main body is made higher than that of the central part, in other words, the resin is unevenly distributed, and its amount is larger in the peripheral part (therefore it is smaller in the central part), thereby the peripheral part becomes hard and the central part becomes soft.

To be more specific, such uneven distribution of the resin is carried out by controlling the removal of the solvent from the fiber bundle, which is impregnated with the resin solution.

Means for bonding a fiber bundle with a resin by uneven distribution of the resin in the peripheral part of the bundle, include a method in which a fiber bundle, which is cut to an appropriate length, is immersed in a resin solution for a certain length of time and a method of spraying a resin solution. Industrially and from the viewpoint of conditions of controlling the removal of the solvent as well, conversion of an apparatus conventionally employed for producing nibs and the like from fiber bundles is desirable.

That means, the apparatuses which have been conventionally employed for producing nibs and the like have been so devised that the uneven distribution of the resin is prevented to maintain the uniformity of the quality of the products, and each condition has been exactly established.

According to the present invention, such devices and the conditions can be cancelled or changed to provide a fiber bundle bonded with a resin, which is distributed unevenly and exists more in the peripheral part.

Now, referring to FIG. 1, an example of an apparatus for producing an applicator according to the present invention will be explained.

The production apparatus comprises a bobbin 3 having reeled up continuous multiple fibers 1, feed rolls 2 for adjusting tension, a heating block 4 to heat the multiple fibers 1 to form them into the shape of a bundle, a resin solution bath 7 for impregnating the produced fiber bundle with the resin, a hot-air drying chamber 11 wherein the resin having impregnated the fiber bundle is cured, draw rolls 12 and a cutter 13 to cut the resin cured fiber bundle from the draw rolls 12 to a desired length.

Multiple fibers 1 delivered from the bobbin 3 are sent through feed rolls 2, while the tension is adjusted, into a die 5 wherein they are heated, compressed and molded into a fiber bundle 6 in the form of a column.

The die 5 is generally heated to 210–250° C. for polyester fibers, 170–215° C. for nylon fibers and 190–250° C. for acryl fibers.

The fiber bundle 6 molded into the form of a column through the die 5, is sent through an orifice 8 into the resin solution bath 7, which has orifices 8 and 10.

The fiber bundle is impregnated with a resin solution 9 while it passes through the bath.

The fiber bundle 6 impregnated with the resin solution 9 is supplied into the hot-air drying chamber 11 in which the hot air removes the solvent from the surface of the fiber bundle and cures the resin inside.

During this process, the solvent contained in the resin solution having impregnated is removed by evaporation from the surface of the fiber bundle 6 by hot air.

Then the resin having impregnated the central part moves to the surface of the fiber bundle 6, resulting in the uneven distribution of the resin in the peripheral part.

The fiber bundle 6 present in the hot-air drying chamber 11, however, is a continuous part of the fiber bundle 6 present in the resin solution bath 7.

Therefore, the resin solution 9 is continuously supplied to the fiber bundle 6, which is in the hot-air drying chamber 11, by capillary action.

Accordingly, the amount of the resin to be present in the peripheral part can be controlled by changing the heating conditions variously.

The amount of the resin to be present in the peripheral part of the fiber bundle can also be controlled by the concentration of the resin solution 9 to be used. The temperature of the hot-air drying chamber 11 may be appropriately controlled depending on the kinds of the solvents used for the resin solution 9 and the concentration thereof, but it is normally within a range between 40 and 250° C.

The fiber bundle 6 wherein the hardness of the peripheral part is higher than the hardness of the central part due to the uneven distribution of the resin in the peripheral part, produced in the afore-mentioned way, is pulled by the draw rolls 12 and cut to a desired length of the fiber bundle 14 by the cutter 13.

The fiber bundle 14 having a desired size (thickness) and cut to a desired length is ground at one or both ends; the periphery of a desired length is worked with a grinder and the like to expose the central part of the fiber bundle, which becomes a coating part.

The periphery of the middle part of the fiber bundle is not ground and is used as a holder of the applicator.

When the peripheral part containing a larger amount of the resin is ground in an angular, semispherical, cylindrical, or bullet-like form, a central part (coating part) is exposed, which is soft as it does not contain much resin, and the tip thereof is loosened by a small stress to give a soft feel on use.

Figure 2A:
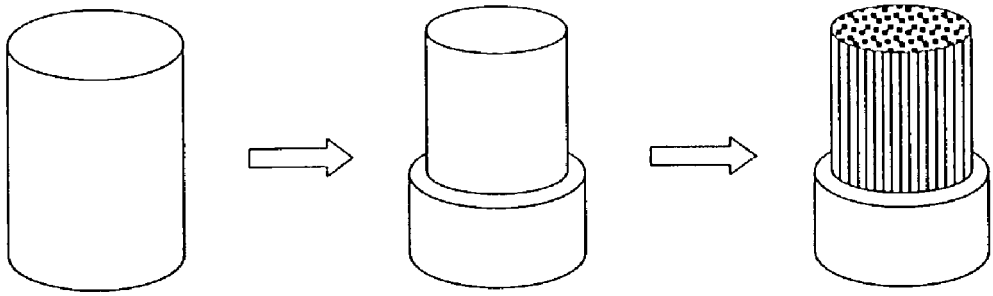
FIG. 2A, FIG. 2B and FIG. 2C are explanatory drawings illustrating how the peripheries are ground during the production process.
Figure 2B:
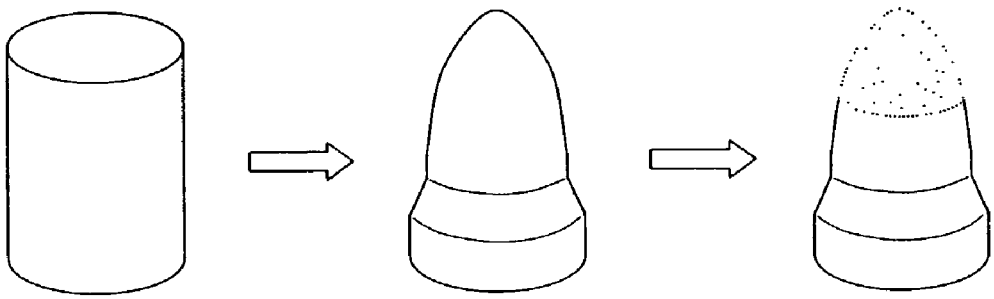
Figure 2C:
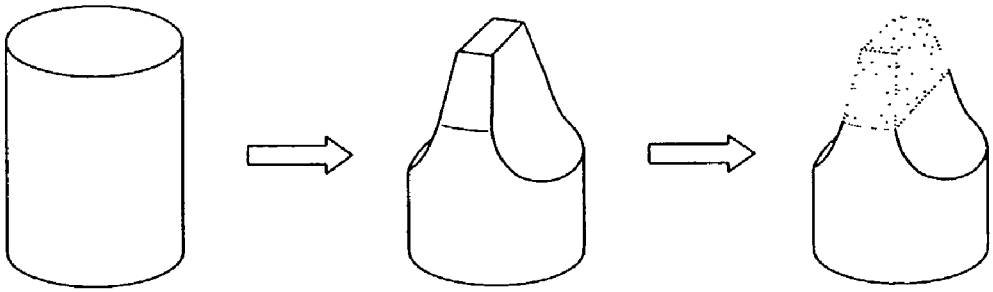

In this case, as shown in FIG. 2, if stress is applied to the central part by kneading and the like, the fiber bundle is loosened well to have a shape of a brush (FIG. 2A), or the fiber bundle can be partly loosened to have a shape of a bullet (FIG. 2B) or a chisel (FIG. 2C), and the soft feel on use can be further improved.

The softness and the feel on use, or the retention of the material to be coated, can be freely controlled by the diameter of the fiber bundle, the kinds and the amount of the fibers, the kinds and the amount of the resins, and the length and the thickness of the ground part. In addition to that, it can be controlled by the shape of the fiber bundle, such as a columnar, prismatic and planar form.

Figure 3:
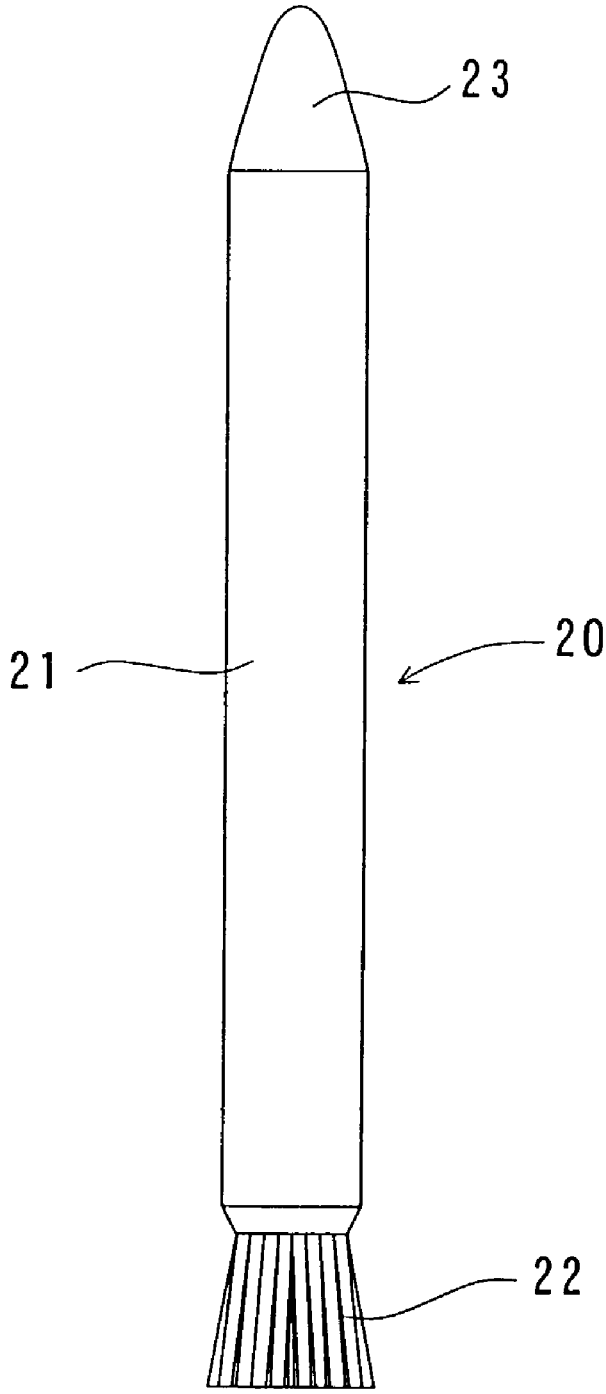
FIG. 3 is an explanatory drawing showing one example of the form of an applicator according to the present invention.
Figure 4:
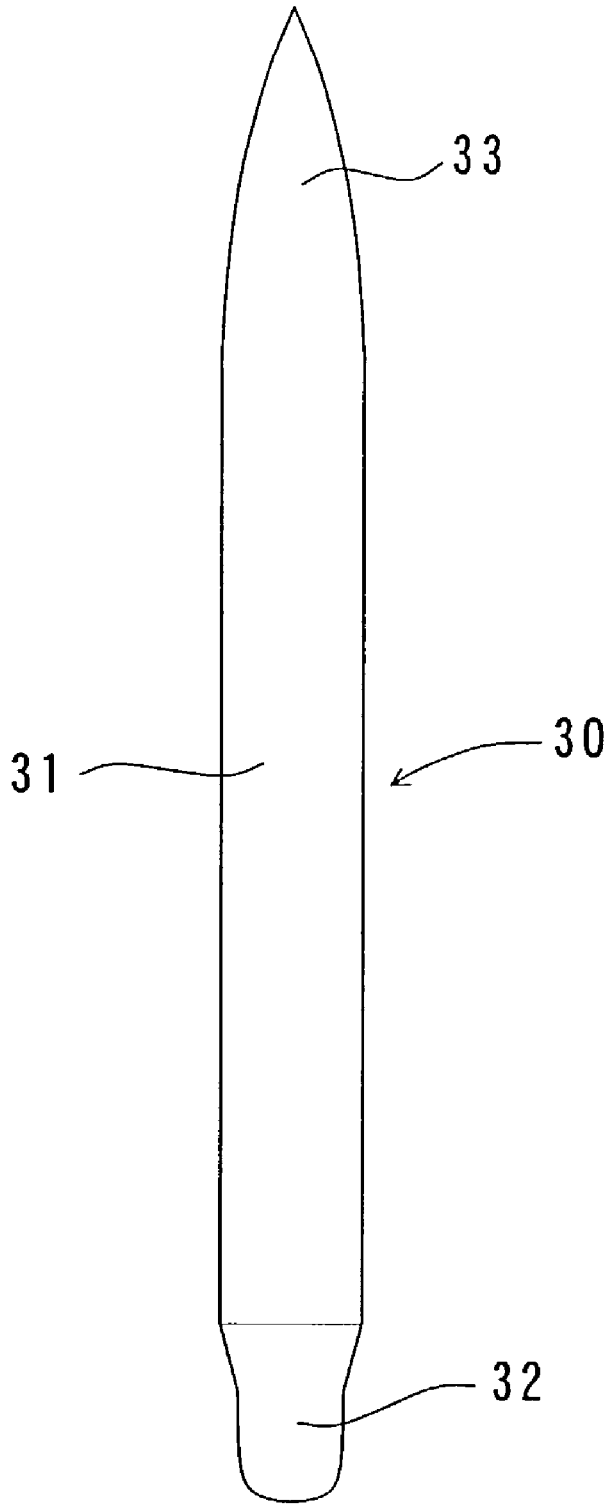
FIG. 4 is an explanatory drawing showing another example of the form of an applicator according to the present invention.

As shown in FIG. 3 and FIG. 4, the applicator according to the present invention can have coating parts by grinding the peripheral parts at both ends of a fiber bundle having a predetermined size.

As it is shown in FIG. 3, an end can be made into the form of a brush, and the other end can be made into the form of a bullet, or as it is shown in FIG. 4, one end can be made to have an acute edge, and the other end can be made into a semispherical form. These can be arbitrarily combined according to the uses and the purposes.

An applicator according to the present invention comprises a holder made of a hard peripheral part in which the resin exists in a larger amount and a coating part made of an end wherein the surface is ground to expose the central part.

In this context, the characteristics of the applicator largely depend on the amount of the resin, which is unevenly distributed in the applicator and presents in a larger amount on the surface. Therefore, it is very important for the present invention to control the amount of the impregnating resin, which is unevenly distributed.

It is not easy to measure the amount of the resin, which has impregnated and is unevenly distributed in the fiber bundle.

However, as the hardness of the fiber bundle changes according to the amount of the resin, the amount of the resin can be estimated by measuring the hardness, so that the properties of the applicator can be adjusted, and that is preferred for the present invention.

According to the present invention, the hardness of the fiber bundle bonded with the resin is the Durometer hardness measured by JISK 6301 A type and is preferably 30–100 in the peripheral part wherein the resin exists in a larger amount, more preferably it is 40–100, in particular, more preferably it is 60–100.

In the central part, the hardness is preferably up to 70, more preferably up to 60 and in particular more preferably up to 50.

The hardness of the peripheral part of below 30 is not preferable, since the holder part may be broken by a small stress during the use. The hardness of the central part over 70 is also not preferable, since the coating part is not easily loosened and the feel on use is worsened.

The hardness was measured on a section cut in a direction perpendicular to the axial direction using JISK 6301 A type durometer hardness tester.

The ratio of the hardness of the peripheral part and that of the central part generally represents the uneven distribution of the resin. Therefore, it is preferred that the hardness of the peripheral part is at least 1.3 times, more preferably at least 1.5 times, and in particular more preferably at least 1.9 times that of the central part, in order to secure good properties of the applicator of the present invention. The upper limit of the hardness ratio is preferably up to 7.0 times.

As such hardness ratio results from the uneven distribution of the resin, an applicator having a synthetic resin coating on the periphery, which will be explained later, can be sufficiently used even though it may have a ratio beyond this range.

The applicator produced in a method described above can be used as it is. The holder part or the coating part can be colored with a dye for enjoyment of changes in appearance. There is no special limitation on the dyes to be used, however, when polyester fibers are employed, a disperse dye is desirable.

The holder part can be coated with a synthetic resin and armored with a shrink film and the like to make the applicator easier to use. Use of a colored shrink film, can add variations in the appearance. The armoring film can be made to slide and protect the coating part in the form of a brush when the coating part is not used.

The applicator according to the present invention is held by a hand at the holder, to apply a coating material such as a powder, gel and liquid which is separately prepared, with its coating part.

In such a case, a tubular body containing a liquid coating material can be connected to one end of the applicator and the other end of the applicator can be made as a coating part to coat the liquid coating material, or the holder can be releasably attached to one end of a wooden axis such that the applicator can be replaced for different materials to be coated.

The applicator according to the present invention can be used for cleaning precision members using a detergent and the like as the coating material.

EXAMPLES

Example 1

Polyester fibers with a thickness of 3 dtex were bundled into a total size of 44,000 dtex while adjusting the tension and subjected to hot compression molding in a cylindrical die and the resulting columnar fiber bundle having an outer diameter of 4 mmϕ, was introduced through an orifice into a resin solution bath and passed through the resin solution of the following composition.

| Composition of the resin solution | |
|---|---|
| Urethane resin (isocyanate + polyol) | 3% by weight |
| Methylene chloride | 97% by weight |

The columnar fiber bundle impregnated with the resin solution was passed through a hot-air drying chamber, the entrance temperature and the exit temperature of which were set at 100° C. and 190° C. respectively, and the solvent was removed and the resin was cured.

The produced columnar fiber bundle had an outer diameter of about 4±0.05 mmϕ the voids inside was about 65%, the hardness (Durometer hardness) of the central part was 32, the hardness of the peripheral part was 63 (the hardness ratio of 1.973), the resin was unevenly distributed and the peripheral part had a larger resin content.

The columnar fiber bundle was cut to a length of 50 mm and the periphery of a part within 10 mm from the end was ground with a grinder. When the exposed central part of the fiber bundle was kneaded, the fibers were readily loosened and made into the form of a brush, to provide an applicator having excellent coating properties.

Example 2

Various applicators have been produced based on the process of EXAMPLE 1 while conditions including the kinds and the thickness of the fibers, thickness of the fiber bundles, the kinds and the concentrations of the resins were changed. The results are given in Table 1.

TABLE 1

| Test Example | Hardness: Central Part | Hardness: Peripheral Part | Hardness: Ratio | Easiness of loosening |
|---|---|---|---|---|
| 1 | 78 | 91 | 1.171 | X |
| 2 | 65 | 79 | 1.218 | Δ - X |
| 3 | 37 | 46 | 1.224 | X |

TABLE 1-continued

| Test Example | Hardness: Central Part | Hardness: Peripheral Part | Hardness: Ratio | Easiness of loosening |
|---|---|---|---|---|
| 4 | 57 | 88 | 1.555 | Δ |
| 5 | 48 | 77 | 1.625 | Δ |
| 6 | 35 | 67 | 1.900 | Δ |
| 7 | 50 | 96 | 1.940 | ○ |
| 8 | 42 | 86 | 2.047 | ○ |
| 9 | 34 | 89 | 2.600 | ○ |
| 10 | 19 | 25 | 1.337 | X |

Example 3

A brush-like applicator was produced in a method similar to that used in EXAMPLE 1 except that a fat red dye (Kayaset Red K-BL manufactured by NIPPON KAYAKU CO., LTD.) was dissolved in the resin solution in an amount of 0.01% by weight.

Figure 5:
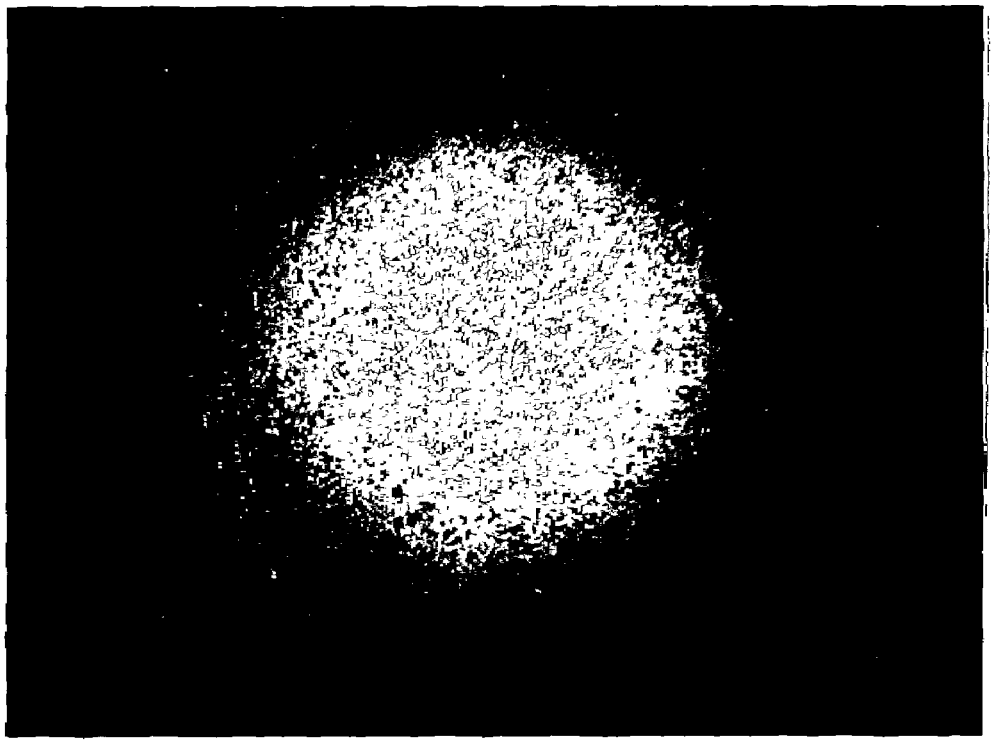
FIG. 5 is a microphotograph of a section of an applicator according to the present invention.

The columnar fiber bundle in the middle of the production contained a larger amount of the resin in the peripheral part of the fiber bundle, as it is clearly seen from the microphotograph of its section (FIG. 5), the peripheral part was colored red and the color was faded towards the center.

The brush-like applicator obtained by grinding this columnar fiber bundle with a grinder had a red holder (because of unground the periphery) and a white brush.

Example 4

The applicator produced in EXAMPLE 3 was dyed in an aqueous solution containing a yellow dye for polyester (COLD-DYE HOT H5 YELLOW manufactured by Katsuraya Fine Goods Co., Ltd.) in an amount of 0.025 weight % to which a dyeing aid was added in an amount of 0.25 g/l, at 95° C. for 1 hour.

The applicator was subjected to reduction cleaning using a 0.025 weight % soaping solution at 80° C. for 10 minutes to wash out the excess dye to obtain an applicator having a yellow brush and an orange holder.

What is claimed is:

1. An applicator for a makeup instrument having a main body made by bonding a fiber bundle with a synthetic resin, and characterized by one or two coating parts obtained by grinding the peripheral part of either or both ends of said main body and a holding part being the unground middle part of said main body, wherein said bonding is carried out in such a way that the Durometer Hardness measured by JISK 6301 A type of said peripheral part is not less than 30 and at least 1.3 times higher than the Hardness of the central part of the said main body.

2. An applicator according to claim 1, wherein the difference in the hardness between said peripheral part and said central part arises from a distribution of a larger amount of the synthetic resin employed for bonding the fiber bundle in the peripheral part than in the central part.

3. An applicator according to claim 1, wherein the synthetic resin employed for said bonding is polyurethane resin and the fiber bundle is polyester fiber bundle or nylon fiber bundle.

4. An applicator according to claim 1, wherein the fiber bundle is loosened in the coating part.

5. An applicator according to claim 1, wherein the coating part has an angular, semispherical, cylindrical, or bullet-like form.

* * * * *